US012251754B2

(12) United States Patent
Cerutti et al.

(10) Patent No.: US 12,251,754 B2
(45) Date of Patent: Mar. 18, 2025

(54) INJECTION-MOLDING DEVICE AND METHOD FOR MANUFACTURING PARTS MADE OF METALLIC GLASS

(71) Applicant: VULKAM, Gieres (FR)

(72) Inventors: Xavier Cerutti, Saint-Egreve (FR); Sebastien Gravier, Murianette (FR)

(73) Assignee: VULKAM, Gieres (FR)

( * ) Notice: Subject to any disclaimer, the term of this patent is extended or adjusted under 35 U.S.C. 154(b) by 747 days.

(21) Appl. No.: 17/415,992

(22) PCT Filed: Dec. 20, 2019

(86) PCT No.: PCT/FR2019/000215
§ 371 (c)(1),
(2) Date: Jan. 28, 2022

(87) PCT Pub. No.: WO2020/128170
PCT Pub. Date: Jun. 25, 2020

(65) Prior Publication Data
US 2022/0161319 A1 May 26, 2022

(30) Foreign Application Priority Data
Dec. 20, 2018 (FR) ..... 1873662

(51) Int. Cl.
*B22D 29/00* (2006.01)
*B22C 1/00* (2006.01)
(Continued)

(52) U.S. Cl.
CPC ..... *B22D 29/002* (2013.01); *B22C 1/00* (2013.01); *B22D 17/10* (2013.01); *B22D 17/22* (2013.01)

(58) Field of Classification Search
CPC ..... B22D 29/002; B22D 17/10; B22D 17/22; B22C 1/00
See application file for complete search history.

(56) References Cited

U.S. PATENT DOCUMENTS 6,793,000 B2 * 9/2004 Fink ..... B22D 17/04 164/113
8,807,198 B2 * 8/2014 Bullied ..... B22D 17/10 164/113
(Continued)

FOREIGN PATENT DOCUMENTS

EP 1918409 A2 5/2008

OTHER PUBLICATIONS

Melting Point of Common Metals, Alloys, & Other Materials; https://www.americanelements.com/meltingpoint.html (Year: 2024).*
(Continued)

*Primary Examiner* — Kevin P Kerns
*Assistant Examiner* — Steven S Ha
(74) *Attorney, Agent, or Firm* — McBee, Moore & Vanik IP, LLC

(57) ABSTRACT

Device and method for injection moulding a metal alloy intended for manufacturing at least one part made of an amorphous metal alloy or metallic glass, wherein: an injection mould (2) delimits a cavity that has a receiving face (4) and a frontal moulding face (5) opposite the receiving face, at least one sacrificial shaping insert (7) is placed in said cavity and has a rear face (8), at least one contact zone of which is adjacent to at least one contact zone of said receiving face of the cavity and a front face (9) that is situated opposite said moulding face of the mould and provided with a recessed shape, and an injection piston (I I) is movable in a chamber (12) of the mould and communicates with the moulding impression.

19 Claims, 5 Drawing Sheets

(51) Int. Cl.
*B22D 17/10* (2006.01)
*B22D 17/22* (2006.01)

(56) References Cited

U.S. PATENT DOCUMENTS

| | | | | |
|---|---|---|---|---|
| 9,314,839 | B2 | 4/2016 | Prest et al. | |
| 2010/0084110 | A1* | 4/2010 | Strom | B22D 19/04 164/498 |
| 2017/0087626 | A1 | 3/2017 | Verreault | |

OTHER PUBLICATIONS

International Search Report of International Patent Application No. PCT/FR2019/000215 mailed Mar. 30, 2020.
P. Zeman et al., "Amorphous Zr—Cu thin-film alloys with metallic glass behavior", Journal of Alloys and Compounds., CH, Mar. 1, 2017, pp. 1298-1306, vol. 696.
C. Suryanarayana et al., "Bulk Metallic Glasses", Taylor & Francis Group, 2017.
Zhijing Zhu et al, "Fabricating of Zr-Based Bulk Metallic Glass Microcomponent by Suction Casting Using Silicon Micromold Dies", Hindari Publishing Corporation, Article ID 362484, vol. 2014.
Zhijing Zhu et al, "Hot Embossing of Zr-Based Bulk Metallic Glass Micropart Using Stacked Silicon Dies", Hindari Publishing Corporation, Article ID 179714, vol. 2015.
Kumar et al,Bulk Metallic Glass The Smaller the Better, Advanced Materials, 2010, pp. 1-16, vol. XX.

* cited by examiner

[Fig 1]
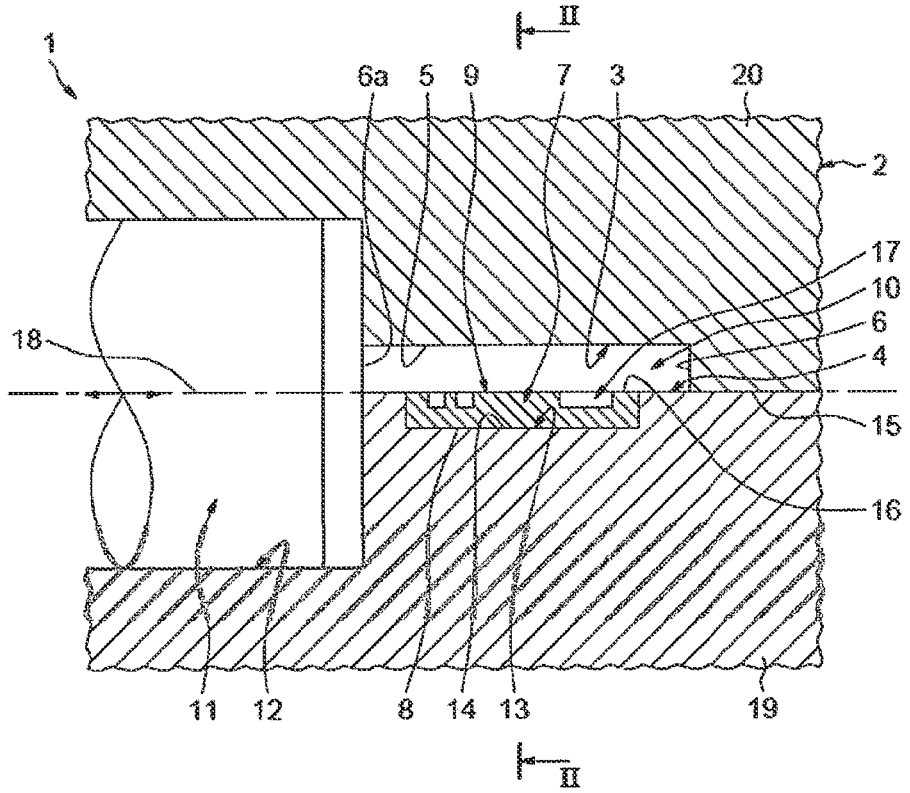
[Fig 2]
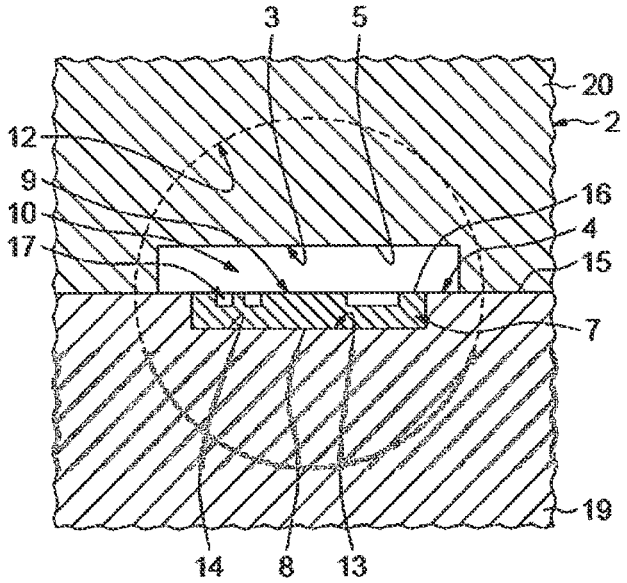

[Fig 3]
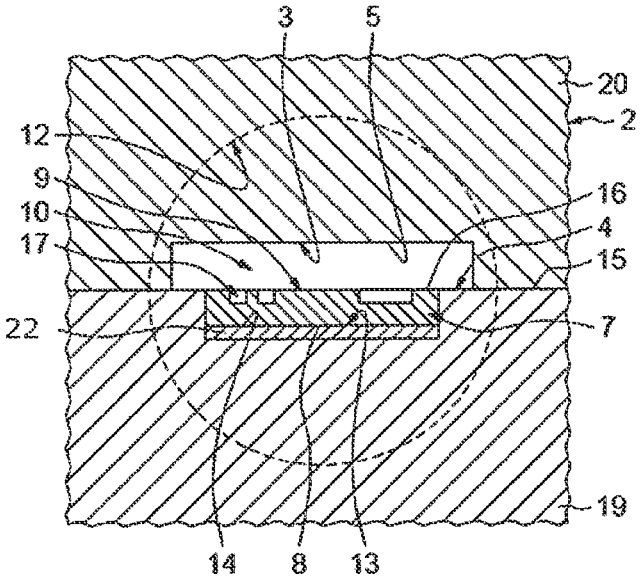
[Fig 4]
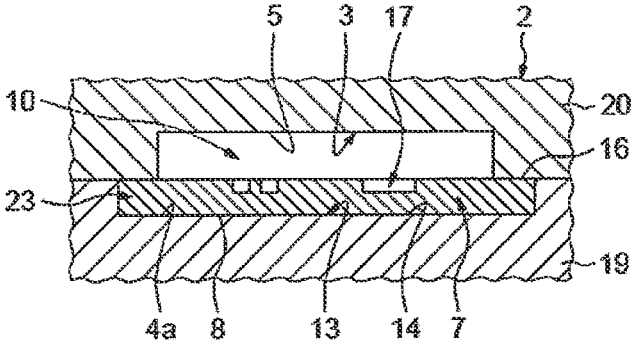

[Fig 5]
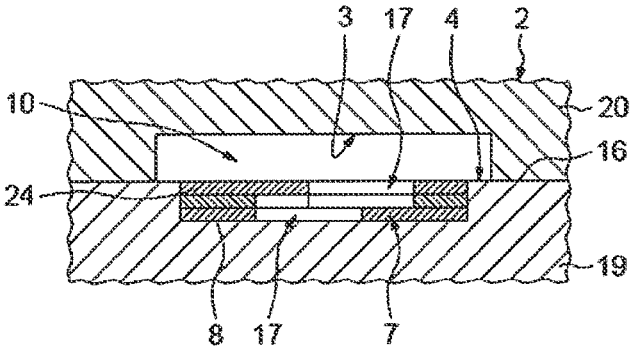
[Fig 6]
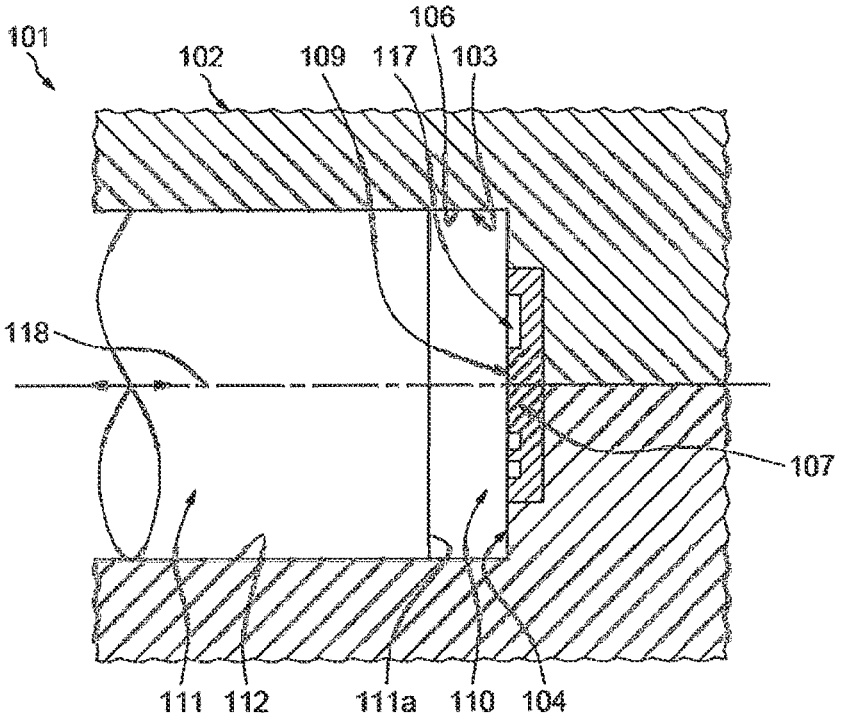

[Fig 7]
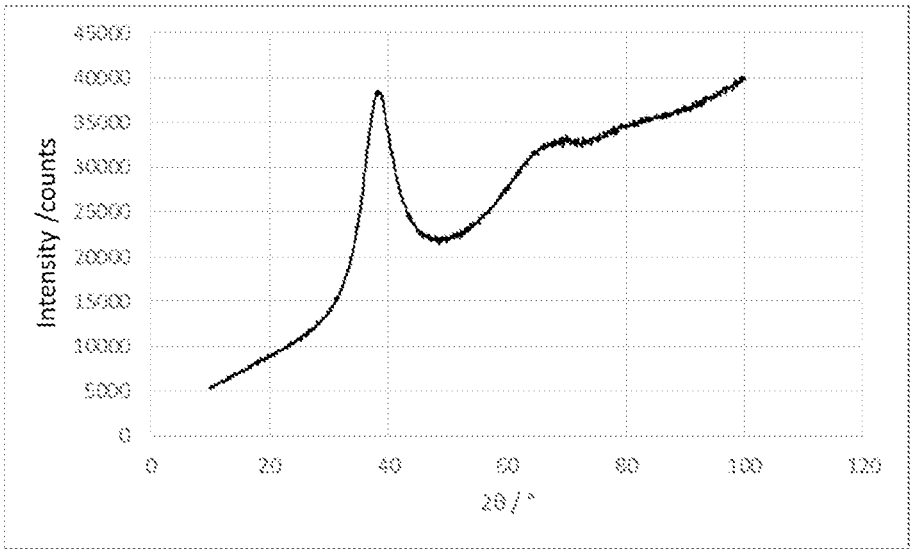
[Fig 8]
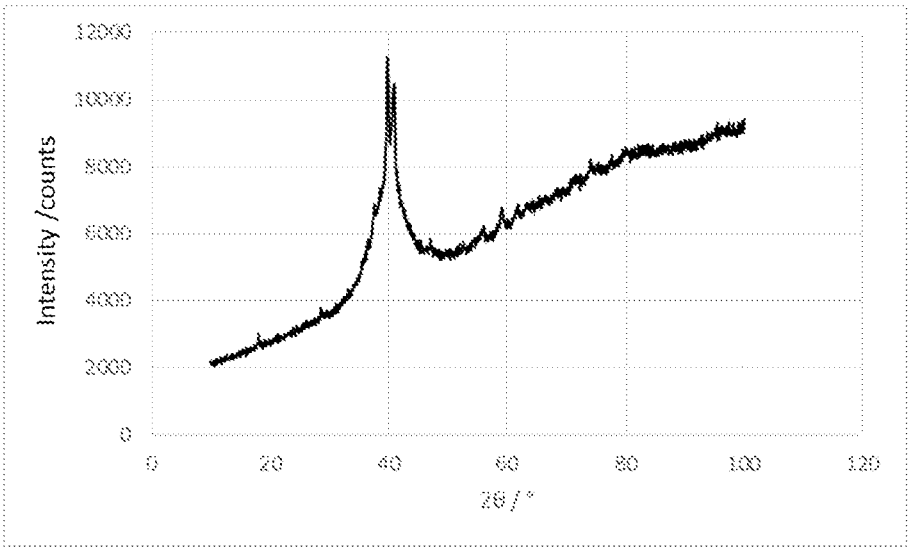

[Fig 9]
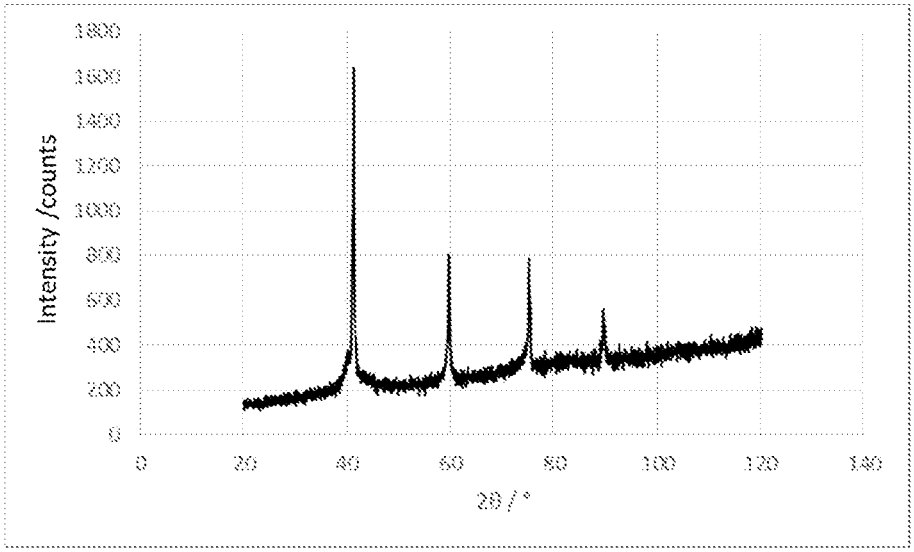
[Fig 10]
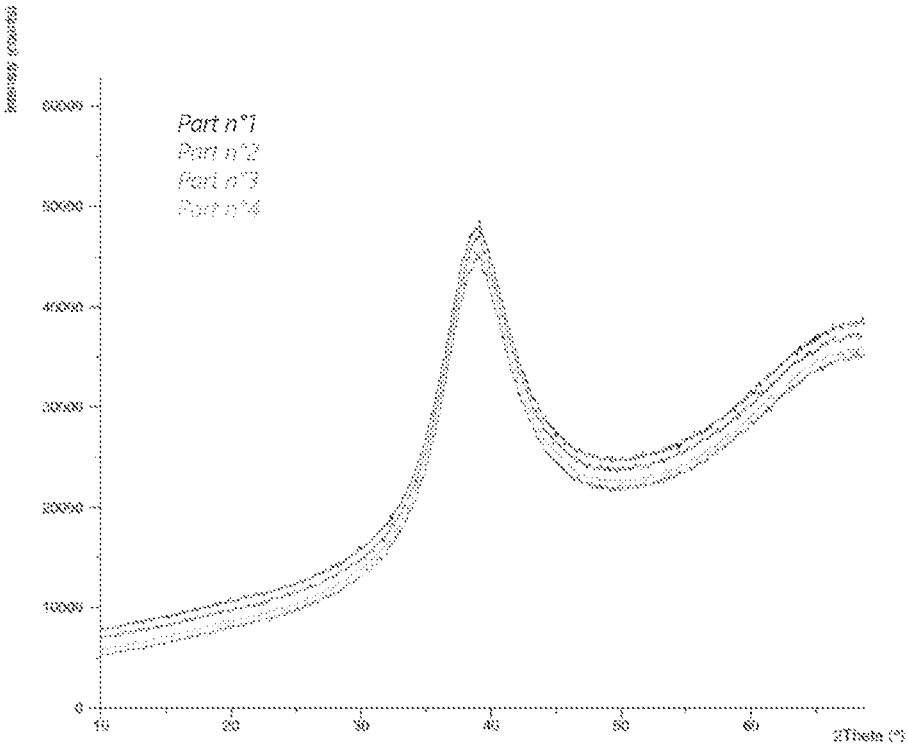

INJECTION-MOLDING DEVICE AND METHOD FOR MANUFACTURING PARTS MADE OF METALLIC GLASS

CROSS-REFERENCE TO RELATED APPLICATIONS

This application is the National Stage entry of International Application No. PCT/FR2019/000215, filed 20 Dec. 2019, which claims priority to French Application No. 1873662, filed 20 Dec. 2018.

BACKGROUND

Field

TECHNICAL FIELD

The present disclosure relates to the field of production by injecting parts made of metallic glass, also referred to as amorphous metals or amorphous metallic alloys (AMAs). In particular, the invention relates to an injection molding device intended for manufacturing at least one part made of amorphous metallic alloy, a method for manufacturing at least one part made of amorphous metallic alloy and a part able to be obtained according to said method.

DESCRIPTION OF RELATED ART

A metallic glass is conventionally obtained by specific manufacturing methods comprising in particular a rapid cooling of a molten metallic alloy, the chemical formulation of which is specifically suitable for the amorphous character to be at least partly maintained after solidification.

In general terms, the name "amorphous metallic alloys" or "metallic glass" applies to metals or metallic alloys that are not crystalline, that is to say which have a mainly random atomic distribution.

The amorphous structure of metallic glass confers thereon particularly interesting properties: very high mechanical strength, great capacity for elastic deformation, which is generally greater than 1.5%, and high resistance to corrosion and abrasion. Producing AMAs is already known, in particular based on zirconium (Zr), magnesium (Mg), iron (Fe), copper (Cu), aluminum (Al), palladium (Pd), platinum (Pt), titanium (Ti), cobalt (Co), nickel (Ni), and hafnium (Hf). Lists of specific metallic alloys making it possible to produce metallic glass are indicated in particular in the document by C. Suryanarayana and A. Inoue (2017), entitled "Bulk Metallic Glasses" and accessible through the internet link https://doi.org/10.1201/9781315153483).

One method for manufacturing parts made of metallic glass consists in injecting the liquid material into the cavity of a mold and solidifying the material under specific adapted conditions of injection speed and cooling. Manufacturing with extreme precision, for example a precision of less than 5 μm or even less than or equal to 1 μm, parts made of AMA of very small dimensions (in particular with a length of between 0.1 mm and 25 mm, preferentially 0.5 mm and 10 mm in the largest dimension of the part) and having a high height/thickness ratio generally requires complex manufacturing methods involving a casting step, a step of thermoforming a preform and a finishing step of removing material in order to end up with the final AMA part. The step of removing material is generally implemented by machining or by "hot scraping" (Schroers et. al (2007) "Thermoplastic forming of bulk metallic glass—Applications for MEMS and microstructure fabrication", accessible by the internet link https://doi:10.1016/j.msea.2006.02.398).

The U.S. Pat. No. 8,807,198 describes a method for producing a metal component by injection, wherein the cavity of a mold is provided with a sacrificial core for producing a cavity inside the metal component. The metal is injected and cooled. After removal from the mold, the sacrificial core attached to the molded part is destroyed. The insert may be made from a refractory metal.

The document US2017/0087626 A1 describes a complex method for manufacturing a part made of an amorphous metallic alloy comprising in particular the steps of three-dimensional printing of a wax model of the form of the part, introducing a wax model into the casting mold, casting a sacrificial shell of constant thickness between the casting mold and the wax model, dissolving the wax model, casting an AMA in place of the wax model, quenching the cast AMA part and removing said part from the mold.

The U.S. Pat. No. 9,314,839 describes a method for producing a part made of metallic glass, by injecting a metallic alloy into a cavity defined between two parts of a mold, one of the parts of the mold having a protuberance forming a core engaged in the other part. After removal from the mold, the protuberance engaged in the molded component is destroyed by etching.

The document published by the journal "Hindari Publishing Corporation", Volume 2014, Article ID 362484, under the title "Fabricating of Zr-Based Bulk Metallic Glass Microcomponent by Suction Casting Using Silicon Micromold Dies" (in particular accessible through the internet link: https://dx.doi.org/10.1155/2014/362484) describes a method for producing a part made of metallic glass by flowing a metal alloy by suction through a channel wherein an intermediate support is placed, so that the liquid material flows in front of, on either side of and behind this support. On the support a shape is disposed, corresponding to the part to be produced, on which a part of the flowing material rests.

The document published by the journal "Hindari Publishing Corporation", Volume 2015, Article ID 179714, under the title "Hot Embossing of Zr-Based Bulk Metallic Glass Micropart Using Stacked Silicon Dies" (in particular accessible through the internet link: https://dx.doi.org/10.1155/2015/179714) describes a method for producing a part made of metallic glass by embossing or stamping a billet of material on top of a counter-shape.

The document EP 1 918 409 A2 describes AMA parts specifically manufactured for serving as an authenticity-check device. The AMA parts can be produced either by casting and then pressing the cast alloy or by thermoforming an alloy in a mold comprising a region on the irregular surface having a roughness Ra of between 0.1 μm and 1000 μm. The manufacturing methods described in this document are however not adapted for obtaining a part made of AMA of lower thermal stability, and with very small dimensions and complex geometry, or having a high height/thickness ratio. In particular, the casting and pressing method requires a time during which the alloy will be in contact with the mold without applying pressure and therefore without perfectly filling the impression. This will create cold spots, which are liable to prevent industrial production and good repeatability of the manufacturing method, in particular for the following potentially cumulative reasons:

the production of complex parts is compromised (shapes with small dimensions, fine and with high shape ratios), obtaining a part of good quality is made difficult (the cold spots may cause differences in viscosity and therefore behavior during filling), the reliability of the method is not guaranteed (control of the casting of the alloy in the mold), obtaining parts made of alloys that are not stable thermally is problematic (the time between casting and applying pressure must be sufficiently great not to cool the alloy sufficiently quickly and therefore create metallurgical defects such as crystals).

The methods currently proposed are therefore not satisfactory for the manufacturing operations to be easy and for the AMA parts obtained to have sufficient qualities. Furthermore, in relation to AMA parts of very small dimensions (in particular with a length of between 0.1 mm and 25 mm, preferentially 0.5 mm and 10 mm in the largest dimension of the part) and having a high height/thickness ratio and very fine geometry characteristics (surface pattern with a precision of less than 5 μm or even less than or equal to 1 μm) are currently manufactured by thermoforming methods.

Thermoforming methods consist of heating, to a temperature higher than the glass transition temperature of AMA (Tg), an alloy billet in solid form and already having an amorphous structure and forming it by means of a mechanical pressure. These methods therefore make it necessary to initially obtain an amorphous billet by casting, these billets then being thermoformed. During the thermoforming they undergo a rise in temperature, a temperature that is maintained throughout the shaping. Once the shaping has ended, the alloy is cooled to a temperature less than Tg.

When an AMA is raised to a temperature close to Tg again, atomic mobility is facilitated and viscosity reduced, thus enabling it to be shaped. However, this atomic mobility may also facilitate the organization of the atoms and therefore the crystallization of the AMA billet. In order to keep the amorphous structure of the part during the thermoforming, the alloy must therefore have sufficiently high thermal stability to allow shaping without crystallizing. This is all the more important in the case of the shaping of microcomponents with high shape ratios, where a longer shaping time is necessary. Conventionally, for thermoforming, the parameters used are a temperature making it possible to obtain a viscosity of between $10^6$ and $10^8$ Pa·s and maintenance times at these temperatures before crystallization of the order of 3 to 5 min (Kumar et al. 2011, Bulk Metallic Glass The Smaller the Better, in particular accessible through the internet link: https://doi.org/10.1002/adma.201002148). Currently, manufacturing microcomponents is therefore limited to the use of compositions having high thermal stability, that is to say a thermal stability such that ΔTx of the AMA is greater than 100, with ΔTx the difference in temperature ΔT between the crystallization Tx and the glass transition temperature Tg, and/or also such that the standardized thermal stability criterion ΔTx/(Tl−Tg) is higher than 0.18. Using thermally stable AMAs limits the alloy compositions that can be used and the most stable alloys do not necessarily exhibit the property compromises that are the most advantageous according to the application sought. In addition, alloys having good thermal stability generally comprise elements such as precious metals, which are therefore very expensive and not adapted to industrial production. Other alloys with good thermal stability contain harmful elements such as beryllium.

In addition, the methods involving a thermoforming step require several manufacturing steps (casting of the billet and then thermoforming) and very long shaping times, which makes such methods difficult to implement industrially.

There is also a need for an easy manufacturing method that is easy to implement industrially whatever the thermal stability of the AMA. Furthermore, there is a need for AMA parts with lower thermal stability having a particular shape ratios and sufficient qualities.

SUMMARY

According to one embodiment, a device for injection molding a metallic alloy is proposed, intended for manufacturing at least one part made of amorphous metallic alloy or metallic glass, which comprises:

an injection mold delimiting a cavity that has a receiving face and a frontal molding face opposite the receiving face, at least one sacrificial insert, placed in said cavity and having a rear face, at least one contact zone of which is adjacent to at least one contact zone of said receiving face of the cavity and a front face located opposite said molding face of the mold and provided with a recessed shape, a molding impression corresponding to the space left free in the cavity comprising the sacrificial insert, and an injection piston movable in a chamber of the mold, which communicates with the molding impression;

wherein the molding impression is configured so that the diameter of the geometry spheres inscribed in said molding impression and having at least one point of contact with the sacrificial insert is no more than one and a half times (1.5 times) the critical diameter of the metal alloy, preferentially no more than one and two tenths times (1.2 times) the critical diameter of the metallic alloy, or no more than one time (1 time) the critical diameter (Dc) of the specific metallic alloy.

Said cavity may be configured so that, after removing the part provided with the sacrificial insert from the mold, at least said contact zone of the rear face of the sacrificial insert is uncovered.

The cavity may have a peripheral face joined to the receiving face.

The peripheral edge of the receiving face may be joined to the end edge, which is adjacent thereto, of the peripheral face of the cavity.

The sacrificial insert may be in the form of a plate.

The frontal molding face may comprise a face of the cavity of the mold.

The frontal molding face may comprise a frontal face of the injection piston.

The contact zone of the rear face of the sacrificial insert may be adhesively bonded on top of the contact zone of the receiving face of the mold cavity.

At least one portion of the periphery of the sacrificial insert can be inserted between two portions of the mold.

The receiving face of the cavity may have a recess wherein the sacrificial insert is at least partly engaged.

The sacrificial insert may comprise a plurality of superimposed layers defining between them at least one extension space of the impression.

The sacrificial insert may be composed of at least one material having a thermal conductivity of at least 20 W $m^{-1}$ $K^{-1}$, preferentially at least 40 W $m^{-1}$ $K^{-1}$.

The device may be adapted for manufacturing parts having an elastic deformation capacity of at least 1.2%, preferentially at least 1.5%.

A method for manufacturing at least one part made of an amorphous metallic alloy is also proposed, using an injection mold as previously described, comprising the following steps:

placing said sacrificial insert on top of said receiving face of at least one portion of the mold, assembling the portions of the mold, injecting into said molding impression a metal or a metallic alloy in the liquid state and solidifying the molded metal or metallic alloy to obtain a molded part having at least partially an amorphous structure, preferentially having an amorphous structure, disassembling the mold portions and extracting the molded part provided with the sacrificial insert, and separating the sacrificial insert and the molded part.

A method for manufacturing at least one part made of an amorphous metallic alloy is also proposed, using an injection mold as previously described, comprising the following steps:

assembling the portions of the mold, placing said sacrificial insert on top of said receiving face of at least one portion of the mold, injecting into said molding impression a metal or a metallic alloy in the liquid state and solidifying the molded metal or metallic alloy to obtain a molded part having at least partially an amorphous structure, preferentially having an amorphous structure, disassembling the mold portions and extracting the molded part provided with the sacrificial insert, and separating the sacrificial insert and the molded part.

The mold comprising the sacrificial insert may be heated prior to the injection step to a temperature of between 250° C. and Tg+100° C., preferentially between Tg−150° C. and Tg+30° C. and more preferentially still to Tg±20° C., with Tg the glass transition temperature of the metallic alloy.

The insert and the molded part may be separated by destroying the sacrificial insert, preferentially by destroying the sacrificial insert by a selective chemical attack in a bath.

Before or after the separation step, a step of removing the surplus material may be implemented so as to obtain a definitive part.

The method may comprise a subsequent step of heat treatment of the molded part and/or of a definitive part obtained.

The step of injecting the metallic alloy may have a duration of less than 100 ms, preferably less than 50 ms and more preferentially still less than 20 ms.

A part made from amorphous metallic alloy able to be obtained according to the method according to any one of claims 14 to 17 is also proposed, such that:

the amorphous metallic alloy has:

i) a ΔTx of less than 100° C., preferentially less than 80° C. and more preferentially still less than 60° C., ΔTx being the difference between the crystallization temperature Tx and the glass transition temperature Tg; and/or ii) a standardized thermal stability criterion ΔTx/(Tl−Tg) of less than 0.18, preferentially less than 0.15 and more preferentially still less than 0.12, or less than 0.10;

the part has a) a thickness of less than 100 μm and a height/thickness ratio greater than 8, or b) a thickness of less than 50 μm and a height/thickness ratio greater than 4, or c) a thickness of less than 40 μm and a height/thickness ratio greater than 2.

The faces of the flanks of the part formed by means of a sacrificial insert may have a mean roughness Ra of less than 1 μm, preferentially less than 0.5 μm and more preferentially still less than 0.1 μm.

The part may be formed of a metallic alloy having a Tl greater than 700° C.

BRIEF DESCRIPTION OF THE DRAWINGS

Other features, details and advantages will emerge from the reading of the following detailed description, and from the analysis of the accompanying drawings, on which:

FIG. 1 shows a longitudinal section of a molding device, along the axis of an injection piston;

FIG. 2 shows a cross section along II-II of the molding device in FIG. 1;

FIG. 3 shows a cross section of a variant embodiment of the molding device in FIG. 1;

FIG. 4 shows a cross section of another variant embodiment of the molding device in FIG. 1;

FIG. 5 shows a cross section of another variant embodiment of the molding device in FIG. 1; and FIG. 6 shows a longitudinal section of another molding device along the axis of an injection piston.

FIG. 7 shows a XRD analysis of an amorphous metallic alloy;

FIG. 8 shows a XRD analysis of a partially amorphous metallic alloy.

FIG. 9 shows a XRD analysis of a crystalline metallic alloy.

FIG. 10 shows a XRD analysis of the parts obtained at example 1.

DESCRIPTION OF EMBODIMENTS

In the above, it is necessary to state the following definitions.

"A" or "one" means "at least one" respectively.

Here "amorphous metallic alloy" or "AMA" or "metallic glass" means metals or metallic alloys that are not crystalline, that is to say the atomic distribution of which is mainly random. Nevertheless, it is difficult to obtain a hundred percent amorphous metallic glass since usually a fraction of material remains that is crystalline in nature. Therefore this definition can be extended to metals or metallic alloys that are partially crystalline and which therefore contain a fraction of crystal, as long as the amorphous fraction is in the majority. Generally, the fraction of the amorphous phase is greater than 50%.

Thus "molded part having at least partially an amorphous structure" means a part wherein the fraction of the amorphous phase is greater than 50%.

It is stated here that a metallurgical structure is said to be amorphous or entirely amorphous when an X-ray diffraction analysis as described below does not reveal crystallization peaks.

"Critical diameter" (Dc) of a specific metallic alloy means the maximum limit thickness below which the metallic alloy has an entirely amorphous metallurgical structure or beyond which it is no longer possible to obtain an entirely amorphous metallurgical structure, when the metallic alloy is molded from a liquid state and is subjected to rapid cooling such that the transfer of the heat inside the metallic alloy is optimum. More specifically, the critical diameter is determined by successive molding of cylindrical bars (generally with a length greater than 50 mm) of various diameters, molded from the liquid state under the following conditions:

The alloy is melted at a temperature of Tl+150° C. with Tl the liquidus temperature of the alloy (in ° C.);

It is molded in a mold made of copper of the CuCl type and is cooled to a maximum temperature of approximately twenty degrees Celsius (20° C.). The alloy is produced and molded under inert atmosphere of high purity (e.g. under argon of quality 6.6) or under secondary vacuum (pressure<$10^{-4}$ mbar).

The alloy is molded with a system allowing the application of a pressure differential for facilitating the molding of the alloy and ensuring close contact between the alloy and the walls of the mold in order to ensure rapid cooling of the alloy. The molding step may be implemented at a pressure of 20 MPa. This system may be mechanical (e.g. piston) or gaseous (application of an overpressure).

After molding, the bars are cut in order to obtain a slice (cross section of the cylinder preferentially located towards the middle of the bar, thickness between 1 and 10 mm) and analyzed by X-ray diffraction (XRD) at a minimum to determine whether the slices have an amorphous or partially crystalline structure The critical diameter is then determined as being the maximum diameter for which the structure is amorphous (the presence of protrusions characteristic of AMAs is then revealed by X-ray diffraction). Since there are usually defects in the metallurgical structures, a 100% amorphous alloy is almost impossible to obtain and the critical diameter can be defined as the diameter above which X-ray diffraction analysis clearly shows crystallinity peaks. Such an evaluation of the amorphous character of a metallic alloy is detailed in the article by Cheung et al., 2007 (Cheung et al. (2007) "Thermal and mechanical properties of Cu—Zr—Al bulk metallic glasses)" doi:10.1016/j.jallcom.2006.08.109). It makes it possible to make an average analysis over a surface and to ignore a few inevitable metallurgical defects by analyzing only the crystals of significant sizes (greater than a few nanometers) and/or in significant quantity. FIGS. 7, 8 and 9 show an XRD analysis as described above of a metallic alloy in the amorphous state, the partially amorphous state (the characteristic protrusion of AMAs is found but with the presence of peaks) and crystalline state respectively.

The metallic alloys according to the present description are preferentially selected among the alloys the majority element of which is selected from zirconium, copper, nickel, iron, palladium, titanium, cobalt and hafnium. According to a preferred embodiment, it is an alloy selected from those cited in appendix 2 (pp. 189-192) of the doctoral thesis "Study of the relationships between structural characteristics and dissipation under vibration in solid metallic glasses. Application to inertial sensors" defended on 22 Nov. 2006 by Cédric Haon.

Metallic alloy "in the liquid state" means a metallic alloy having a temperature higher than or equal to its liquidus temperature. The liquidus temperature being determined with DTA (differential thermal analyzer) analyses as in particular described in the document of Li et al., 2012 (Li et al. (2012) "Effects of Cu, Fe and Co addition on the glass-forming ability and mechanical properties of Zr—Al—Ni bulk metallic glasses", in particular accessible through the internet link: https://doi.org/10.1007/s 11433-012-4919-y).

The thermal stability of AMAs can be characterized in several ways, in particular by evaluating:

the critical diameter Dc (as detailed previously), the difference ΔTx between the crystallization temperature (Tx) and the glass transition temperature (Tg) of the AMA; and the standardized thermal stability criterion ΔTx/(Tl−Tg) where Tl is the liquidus temperature of the alloy.

The temperatures are measured by means of a DSC at a rise rate of 20° C./min. The Tg and Tx temperatures are next extracted from the DSC curves. The liquidus temperature Tl is determined with DTA analyses as explained previously. In particular, the liquidus temperature Tl can be determined in accordance with the method indicated in the article. An example is shown in the article by Li et al., 2012 (Li et al. (2012) "Effects of Cu, Fe and Co addition on the glass-forming ability and mechanical properties of Zr—Al—Ni bulk metallic glasses" in particular accessible through the internet link: https://doi.org/10.1007/s11433-012-4919-y) with a rise of 0.67 K/s for the DSC analysis and 0.33 K/s for the DTA analysis. The mean roughness Ra of the molded part is determined in accordance with ISO 25178.

"Sacrificial insert" means a portion of a single-use injection mold. The sacrificial insert may be made from silicon, pyrolytic graphite, a metal (for example aluminum or copper), a glass (for example silica) or a ceramic (for example alumina). It is destroyed after the step of solidifying the molded metallic alloy. The destruction is preferably implemented by a selective chemical attack, more preferentially by a selective chemical attack in a bath.

The thermal conductivity of the insert is evaluated in accordance with the flash method (Parker et al. (2004) "Flash Method of Determining Thermal Diffusivity, Heat Capacity, and Thermal Conductivity", in particular accessible through the internet link: https://doi.org/10.1063/1.1728417).

"Inscribed geometric spheres" means the geometric spheres the maximum diameters of which are such that they are wedged or immobilized between points of the walls of the molding impression.

The molded AMA parts in the cavities of the sacrificial insert have a height, a length and a thickness.

The top surface of the front face of the sacrificial insert 9 or 109 is defined as being the front face 9 or 109 without the faces included in the cavities 17 or 117 of the sacrificial insert. The top surface of the front face of the sacrificial insert 9 or 109 is for example represented by the plane of the surface 16 in FIG. 1.

The height can be defined as being the greatest distance normal to the surface of the part formed by the top surface of the front face of the sacrificial insert 9 or 109 and measured between the surface of the part formed by the top surface of the front face of the sacrificial insert 9 or 109 and the surfaces of the part formed by the cavity 17 or 117 of the sacrificial insert.

The flanks of the part are defined as being the surfaces formed by the cavity 17 or 117 of the sacrificial insert adjacent to the surface of the part formed by the top surface of the front face of the sacrificial insert 9 or 109. The flanks of parts are generally perpendicular to the surface of the part formed by the top surface of the front face of the sacrificial insert 9 or 109, with a tolerance interval of +or − 5°. The flanks may also have angles less than or greater than 90°.

The thickness is defined as being the smallest diameter of the geometric spheres inscribed in the zones of the part formed by the cavity 17 or 117 of the sacrificial insert having at least one point of contact with two flanks of the part.

The shape ratio or height/thickness ratio is defined as being the ratio of height and thickness in a given zone of the part (cross section perpendicular to the surface of the part formed by the top surface of the front face of the sacrificial insert 9 or 109). A part may therefore have a height/thickness ratio that is different for each given zone of the part (according to the variations in dimensions observed in the various zones thereof). "Height/thickness ratio" of the part means the maximum ratio that said part can have.

In other words and according to a preferred embodiment, the height, the thickness and the length of the part can be defined as follows:

Firstly the top surface of the front face of the sacrificial insert 9 or 109 is defined as being the front face 9 or 109 without the faces included in the cavities 17 or 117 of the sacrificial insert. The top surface of the front face of the sacrificial insert 9 or 109 is represented by the plane of the surface 16 in FIG. 1.

The length is defined as being the largest dimension in the plane of the part formed by the top surface of the front face of the sacrificial insert 9 or 109.

In a given zone of the part (cross section perpendicular to the surface of the part formed by the top surface of the front face of the sacrificial insert 9 or 109).

The thickness is defined as being the smallest distance parallel to the plane of the part formed by the top surface of the front face of the sacrificial insert 9 or 109 measured between the faces of the part formed by the cavity 17 or 117 of the sacrificial insert.

The height can be defined as being the greatest distance normal to the plane of the part formed by the top surface of the front face of the sacrificial insert 9 or 109 and measured between the top surface of the front face of the sacrificial insert 9 or 109 and the surfaces of the part formed by the cavity 17 or 117 of the sacrificial insert.

The shape ratio or height/thickness ratio is defined as being the ratio of height and thickness in a given zone of the part. A part may therefore have a height/thickness ratio that is different for each given zone of the part (according to the variations in dimensions observed in the various zones thereof). "Height/thickness ratio" of the part means the maximum ratio that said part can have.

Injection molding devices, intended for manufacturing parts made of metallic glasses, and the operating modes thereof will now be described by way of non-limitative examples, and illustrated by the drawings.

In FIGS. 1 and 2, an injection molding device 1 is illustrated, intended for manufacturing parts made of metallic glass.

The molding device 1 comprises a permanent injection mold 2, in a plurality of portions, which delimits a cavity 3 that has a receiving face 4, a frontal face 5 opposite the receiving face 4 and a peripheral face 6.

The receiving face 4 and the peripheral face 6 of the cavity 3 are joined. In other words, the peripheral edge of the receiving face 4 is joined to the end edge, which is adjacent thereto, of the peripheral face 6. The cavity 3 is therefore completely formed on one side of the receiving face 4.

The molding device 1 comprises a sacrificial insert 7, in the form of a plate, placed in the cavity 3 and having a rear face 8 a contact zone of which is adjacent to a contact zone of the receiving face 4 of the cavity 3 and a front face 9 located opposite the frontal face 5.

A molding impression 10 is thus created, corresponding to the space left free in the cavity 3 after having disposed the sacrificial insert 7 inside the cavity 3, on top of the contact zone of the receiving face 4 of the cavity 3.

A form of the part to be molded in the molding impression 10 is determined by a specific form of the sacrificial insert 7, which constitutes the negative of the part to be molded. The form of the definitive part to be produced can be included in the specific form of the sacrificial insert 7. The rest of the molding impressions 10 can constitute surplus material.

The molding device 1 comprises an injection piston 11 able to move in an injection chamber 12 of the mold, which communicates with the molding impression 10.

The molding device 1 allows the injection molding of a part in a single step (injection under pressure of the molten metallic alloy). This makes it possible in particular to have excellent control of the filling time and of the conformation of the part. The injection molding step taking place in a single step, the filling/confirmation time is thus minimized, thus allowing molding of complexed geometries of small dimensions. This is because rapid filling of the impression limits the cooling of the alloy during filling and makes it possible to fill cavities of very small dimensions and very precisely (very good conformation of the alloy in the cavities of the sacrificial insert). The parts formed in the cavity of the sacrificial insert can then have the characteristics of very small thickness and high height/thickness ratio as claimed as well as a mean roughness Ra of their flanks of less than 1 μm, preferably less than 0.5 μm and more preferentially still less than 0.1 μm Controlling the filling time also makes it possible to fill the section of a molding impression configured so that the diameter of the inscribed geometric spheres, in contact with its opposite lateral walls and having at least one point of contact with the sacrificial insert, is less than 1 mm, preferably less than 0.75 mm and even more preferably less than 0.5 mm. This type of impression allows better thermal control (cooling of the alloy, temperature of the sacrificial insert and temperature of the AMA/sacrificial insert interface). This thermal control therefore also allows the manufacture of parts, with the geometric characteristic cited above, with alloys having Dc's of small dimensions and/or having low thermal stability.

The thermal control also makes it possible to avoid surface crystallization, which may for example appear when injecting alloys with liquidus temperatures above 700° C. or with alloys composed of elements that quickly react with the material of the sacrificial insert. This is because, the shorter the cooling time of the alloy and the more limited the interface temperature, the more limited will be the phenomena of diffusion that may take place between the sacrificial insert and the AMA, or even may be eliminated. Preventing surface crystallization also makes it possible to obtain parts of better quality, with for example better corrosion resistance or fatigue strength.

The molding device 1 can be used in the following manner.

The permanent mold 2 being open so as to open the cavity 3, the sacrificial insert 7 is placed on top of the receiving face 4 of the cavity 3.

Then the portions of the permanent mold 2 are assembled so as to close the cavity 3 and to form the molding impression 10.

Then, under the effect of the piston 11, which moves in the injection chamber 12 and generates an injection pressure, a metallic alloy in the liquid state is injected into the molding impression 10. The temperature of the mold 2 and of the sacrificial insert 7 causes rapid cooling and solidification of the metallic alloy injected into the molding impression 10.

Next the portions of the permanent mold 2 are disassembled so as to remove the part produced, at the same time as the sacrificial insert 7 is extracted.

The cavity 3 is advantageously configured so that, after removing the part produced from the mold, provided with the sacrificial insert 7, at least the contact zone of the rear face 8 of the sacrificial insert 7 above the contact zone of the receiving face 7 of the cavity 3 is uncovered.

Then the sacrificial insert 7 is destroyed, for example by a selective chemical attack of dissolution in an adapted bath, so as to keep only the molded part. After which, in a subsequent step, surplus material on the molded part is removed so as to obtain the definitive part required.

According to a variant embodiment, surplus material is removed from the molded part, and then the sacrificial insert 7 is destroyed.

Advantageously, the definitive part can be determined solely by the material contained inside the hollow form 17. The portion of the molding impression 10 located between the face 16 of the sacrificial insert 7 and the frontal face 5 of the cavity then constitutes surplus material to be removed.

Moreover, a subsequent step of heat treatment of the molded part and/or of the definitive part obtained can be implemented.

The conditions related to the thermal properties of the permanent mold 2 and of the sacrificial insert 7, to the temperature of the metallic alloy in the liquid state and to the injection speed are favorable to obtaining, from the metallic alloy in the liquid state, a molded part made from metallic glass, i.e. having an at least partially amorphous metallurgical structure.

The permanent mold 2 may be made from copper, an adapted steel, or a refractory alloy.

The sacrificial insert 7 is composed of at least one material having a thermal conductivity of at least twenty Watts per meter and per degree Kelvin, 20 $W\ m^{-1}\ K^{-1}$, advantageously of at least forty Watts per meter and per degree Kelvin (40 $W\ m^{-1}\ K^{-1}$).

The sacrificial insert 7 may be made from silicon, pyrolytic graphite, a metal (for example aluminum or copper), a glass (for example silica) or a ceramic (for example alumina).

The molding impression 10 is configured so that the diameter of the geometric spheres inscribed in this molding impression 10 and having at least one point of contact with the sacrificial insert is no more than one and a half times (1.5 times), advantageously no more than one and two tenths times (1.2 times), the critical diameter (Dc) of the specific metallic alloy used, and more preferentially still no more than one time (1 time) the critical diameter (Dc) of the specific metallic alloy used. According to an advantageous embodiment compatible with the previous embodiment, the molding impression is configured so that the diameter of the geometric spheres inscribed in this molding impression and having at least one point of contact with the sacrificial insert is no more than 1 mm, preferably no more than 0.75 mm and even more preferably no more than 0.5 mm. Such a configuration of the impression is thus implemented for the purpose of obtaining a molded part having the metallurgical characteristics of an amorphous metallic alloy or metallic glass, the geometric spheres inscribed and the critical diameter having been defined previously.

According to the example embodiment illustrated in FIGS. 1 and 2, the receiving face 4 of the cavity 3 comprises a recess 13 wherein the sacrificial insert 7 is engaged. The bottom 14 of the recess 13 constitutes a contact zone for the rear face 8 of the sacrificial insert 7.

The peripheral face 6 of the cavity 3 is at a distance from the peripheral edge of the recess 13, so that the receiving face 4 comprises a portion 15 that surrounds the recess 13.

The bottom 14 of the recess 13 and the portion 15 are parallel to each other and are parallel to the frontal face 5 of the cavity 3.

The periphery of the recess 13 is adjusted to the periphery of the sacrificial insert 7 without clearance or with a slight clearance.

The front face 9 of the sacrificial insert 7 comprises a surface 16 located in the plane of the portion 15 of the face 4 of the cavity 3 and recessed with respect to this surface 16, a form 17 corresponding to the negative of a form of the part or to a portion of a part to be molded.

According to an alternative embodiment, the front face 9 of the sacrificial insert 7 comprises a surface 16 located so as to be recessed with respect to the plane of the portion 15 of the face 4 of the cavity 3 and, recessed with respect to this surface 16, a form 17 corresponding to the negative of a form of a part or to a portion of a part to be molded. This embodiment is particularly advantageous in the example embodiment illustrated in FIG. 4 and detailed hereinafter in order to avoid any pressure and/or bending of the sacrificial insert when the mold is assembled.

In the present case, a plurality of different spheres inscribed in the molding impression 10 can be distinguished, between the frontal face 5 of the cavity 3 and the front face 9 of the sacrificial insert 7.

More particularly, inscribed spheres having a point of contact on the frontal face 5 of the cavity 3 and a point of contact on the zones of the front face 9 of the sacrificial insert 7 can be distinguished, for example parallel to the front face 9 of the sacrificial insert 7. Inscribed spheres having a point of contact on the frontal face 5 of the cavity 3 and points of contact on the edges of the hollow form 17 of the front face 9 of the sacrificial insert 7 can also be distinguished. Inscribed spheres having a point of contact on the frontal face 5 of the cavity 3 and points of contact on the edge or edges of the hollow form 17 of the front face 9 of the sacrificial insert 7 can also be distinguished.

The hollow form 17 defined by the sacrificial insert 7, opposite the face 5 of the cavity 3, can be produced over a portion of the thickness of the sacrificial insert 7.

Nevertheless, the hollow form 17 may have one or more portions that pass through the sacrificial insert 7, so that this hollow form 17 extends as far as the receiving face 4 of the cavity 3. In this case, the contact zones of the sacrificial insert 7 and of the receiving face 4 of the cavity 3, one above the other, for example at the bottom of the recess 13, are reduced.

According to the example shown, one of the sides of the peripheral face 6 of the cavity 3, namely the side 6*a*, is open and communicates with the injection chamber 12 of the mold 2. For example, the axis 18 of the chamber 12 and of the piston 11 is located in the plane of the portion 15 of the receiving face 4 of the cavity 3. The piston 11 produces a lateral injection of the material into the molding impression 10. Such a configuration of the device has the advantage of facilitating the repeatability of the method. The impression formed by the cavity (3) and the sacrificial insert in fact guarantees that the diameters of the geometric spheres inscribed in the molding impression 10 and having at least one point of contact with the sacrificial insert are always the same, and this even if the quantity of alloy injected varies slightly from one injection to another. This therefore gives more flexibility to the method with regard to the calibration of the quantity of material to be injected.

In addition, in the event of the elimination of surplus material being necessary, the geometric and dimensional repeatability facilitates the industrial implementation of this step (constant quantity of material to be eliminated, identical positioning for all the parts, etc.).

For example, the mold 2 comprises two portions 19 and 20, the parting plane 21 of which is located in the plane of the portion 15 of the receiving face 4 of the cavity 3, which also contains the axis 18.

According to a particular arrangement shown in FIGS. 1 and 2, the axis 18 of the chamber 12 and of the piston 11 is disposed horizontally. The sacrificial insert 7 can be placed on the bottom 14 of the recess 13. When metallic alloy is injected into the molding impression 10, the injection pressure applies the rear face 8 of the sacrificial insert on top of the bottom 14 of the recess 13. Nevertheless, the sacrificial insert 7 may be adhesively bonded on the bottom 14 of the recess 13.

The axis 18 of the chamber 12 and of the piston 11 could be disposed vertically, the cavity 3 being on top of the injection chamber 12, injection occurring when the piston 11 moves upwards.

According to an example embodiment illustrated in FIG. 3, in order to facilitate the transfer of heat between the sacrificial insert 7 and the permanent mold 2, a layer 22 of a heat-conductive material is interposed between at least the contact zone of the rear face 8 of the sacrificial insert 7 and the contact zone of the receiving face 4 of the cavity 3 of the mold 2.

The heat-conductive layer 22 may for example be made from graphite or aluminum, adapting to the roughnesses of the contact faces of the permanent mold 2 and of the sacrificial insert 7.

In the case of the sacrificial insert 7 in FIGS. 1 and 2, the heat-conductive layer 22 is located between the bottom 14 of the recess 13 and the rear face 8 of the sacrificial insert 7 inserted in this recess 13.

According to an example embodiment illustrated in FIG. 4, the recess 13 of the receiving face 4 of the cavity 3 extends, over at least a portion of the periphery thereof, beyond the peripheral wall 6 of the cavity 3 and the sacrificial insert 7 disposed in such a recess. The sacrificial insert 7 also extends, in a corresponding manner, beyond the peripheral wall 6 of the cavity 3. Thus a peripheral part 23 of the sacrificial insert 7 is adjusted or inserted, without clearance or with a slight clearance, between the two portions 19 and 20 of the permanent mold 2.

According to another particular arrangement that is not shown, the axis 18 of the chamber 12 and of the piston 11 is disposed vertically. The feed chamber 12 is placed below the cavity 3 and therefore below the molding impression 10.

In this case, advantageously, the sacrificial insert 7 is maintained above the receiving face 4 of the cavity 3, for example in the recess 13, by means of a layer of adhesive or by means of an arrangement equivalent to that described above with reference to FIG. 4.

According to an example embodiment illustrated in FIG. 5, the sacrificial insert 7 comprises a plurality of superimposed layers 24 connected to one another. In this way, the hollow form 17 of the sacrificial insert 7 can have portions extending locally between two successive layers, so as to produce complex parts in a staircase shape in the molding impression 10, which includes such a complex hollow form 17.

FIG. 6 illustrates an injection molding device 101 that is differentiated from the injection molding device 1 described previously through the fact that a cavity 103 of a mold 102, in a plurality of portions, is formed by an end portion of a feed chamber 112 wherein an injection piston 111 is able to move along an axis 118.

A receiving face 104 is formed and located opposite a radial frontal face 111*a* of the piston 111 able to move in the injection chamber 112. The receiving face 117, substantially radial, is joined to the peripheral wall 106 of the chamber 112. In other words, a peripheral edge of the receiving face 104 is joined to a peripheral end edge of the peripheral wall 106 of the chamber 112. The cavity 103 is therefore completely formed on one side of the receiving face 4, that is to say on the same side as the frontal face 111*a* of the piston 111.

A sacrificial insert 107 is disposed above the receiving face 104, on the same side as the frontal face 111*a* of the piston 111.

The arrangements and forms described previously with regard to the receiving face 4 and the sacrificial insert 7 can be applied to the receiving face 104 and to the sacrificial insert 107.

More particularly, the sacrificial insert 7 has, from a front face 109 located facing the frontal face 111*a* of the piston 111, a hollow form 117 corresponding, at least partially, to the negative of a part to be molded.

This time, the piston 111 produces a frontal injection of the material in the direction of the receiving face 104 and therefore of the sacrificial insert 107.

The result is that a molding impression 110, including the hollow form 117, is defined in the terminal injection position of the piston 111, between the receiving face 104 provided with the sacrificial insert 107 and the frontal face 111*a* of the piston 111.

The mounting of the sacrificial insert 107 on the receiving face 104 can be equivalent to any one of the mountings of the sacrificial insert 7 on the receiving face 4 of the cavity 3 described previously.

The geometric spheres inscribed in the molding impression 110, described previously, are this time defined with respect to the front face of the piston 111*a*, equivalent to the frontal face 5 of the cavity 3 of the previous example.

The terminal injection position of the piston 111, which delimits the configuration of the molding impression 110, is determined so that the diameter of the geometric spheres inscribed in this molding impression 110 is no more than one and a half times (1.5 times), advantageously one and two tenths times (1.2 times), the critical diameter (Dc) of the specific metallic alloy used, as defined previously, for the purpose of obtaining a molded part having the metallurgical characteristics of an amorphous metallic alloy or metallic glass. According to a preferred embodiment, the diameter of the geometric spheres inscribed in the molding impression 110 is no more than one times (1 times) the critical diameter (Dc) of the specific metallic alloy, preferably no more than 1 mm, more preferentially no more than 0.75 mm and even more preferably no more than 0.5 mm. In particular, such an advantageous embodiment makes it possible to further avoid a reaction with the sacrificial insert and to obtain parts having an optimized surface state, substantially free from surface crystals. Surface crystallization is problematic in particular for the fatigue strength of the parts or corrosion resistance.

According to a variant embodiment, an intermediate molding impression can be formed between the chamber 112 of the mold 102 and the front face 109 of the sacrificial insert 107. The cross section of such a molding impression is configured so that the diameter of the inscribed geometric spheres, in contact with its opposite lateral walls and having at least one point of contact with the sacrificial insert, is no more than one and a half times (1.5 times), preferentially one and two tenths times (1.2 times), and more preferentially still no more than one time (1 time) the critical diameter (Dc) of the specific metallic alloy used. According to an advantageous embodiment compatible with the previous embodiment, the molding impression is configured so that the diameter of the geometric spheres inscribed in this molding impression and having at least one point of contact with the sacrificial insert is no more than 1 mm, preferentially no more than 0.75 mm and even more preferably no more than 0.5 mm.

For example, this intermediate molding impression extends axially to the chamber 112 and is advantageously cylindrical, the diameter thereof being no more than one and a half times (1.5 times), advantageously one and two tenths times (1.2 times) and more preferentially still no more than one time (1 time) the critical diameter (Dc) of the specific metallic alloy used. Advantageously, the molding impression is configured so that the diameter of the geometric spheres inscribed in this molding impression and having at least one point of contact with the sacrificial insert is no more than 1 mm, preferentially no more than 0.5 mm and even more preferably no more than 0.5 mm.

The injection molding device previously described and presented in FIG. 6 has the main advantage of being modular. Modular means here the ease by which it is possible to modify the injection configuration. This is because the diameters of the geometric spheres inscribed in the molding impression (110) and having at least one point of contact with the sacrificial insert can easily be modified by increasing or decreasing the quantity of alloy injected, and this without having to modify the portions forming the mold (102).

The injection mold as described above allows the manufacture of at least one part made from an amorphous metallic alloy, in accordance with a method comprising the following steps:

placing said sacrificial insert on top of said receiving face of at least a portion of the mold, assembling the portions of the mold, injecting, into said molding impression, a metal or a metallic alloy in the liquid state and solidifying the molded metal or metallic alloy to obtain a molded part having at least partially an amorphous structure, disassembling the mold portions and extracting the molded part provided with the sacrificial insert, and separating the sacrificial insert and the molded part.

According to a variant embodiment, the order of the steps of placing the sacrificial insert on top of the receiving face of at least a portion of the mold and assembling the portions of the mold can be reversed. This embodiment is in particular preferred when the insert is loaded automatically in the mold. The molds are then assembled and then the insert is placed via a dedicated opening.

According to one embodiment, the injection and solidification steps are implemented under secondary vacuum, preferentially at a pressure of $10^{-4}$ to $10^{-6}$ mbar. The vacuum makes it possible in particular to limit the contamination of the alloy while it is being formed as well as facilitating the filling of the mold, and therefore affording a perfect match between the mold and the cast AMA (absence of trapped gas).

According to other embodiments, the injection and solidification steps are implemented under primary vacuum (from $10^{-1}$ to $10^{-3}$ mbar) or under controlled atmosphere, for example under argon.

Prior to the injection step, the mold and the insert are heated in order to facilitate filling thereof and to prevent the molten alloy setting before reaching the bottom of the molding impression and in order to ensure very good conformation of the cavities by the alloy (reproduction of the surface states). The heating also makes it possible to limit thermal shocks. The heating temperature is advantageously close to the glass transition temperature Tg of the amorphous metallic alloy being molded, and preferentially the heating temperature, expressed in ° C., is between 250° C. and Tg+100° C., more preferentially again between Tg−150° C. and Tg+30° C. and even more preferentially Tg±20° C.

During the injection step, a pressure is exerted on the molten alloy to ensure filling of the mold and to make it possible to have good heat exchange between the mold and the alloy as well as to ensure great precision of molding. This pressure may be exerted by means of a mechanical system (e.g. a piston) and/or using gaseous overpressure. A negative pressure differential (suction of the alloy) may also be used. According to an advantageous embodiment, the pressure is greater than 1 MPa, preferably greater than 10 MPa. Advantageously it is between 1 MPa and 150 MPa, preferentially between 10 MPa and 80 MPa.

According to an advantageous embodiment, the impression is filled in a time of less than 100 ms, preferentially less than 50 ms and more preferentially still less than 20 ms. In other words, the step of injecting the metallic alloy has a duration of less than 100 ms, preferentially less than 50 ms and more preferentially still less than 20 ms. This rapid filling time, coupled with optimized control of the heat (diameter of the geometric spheres inscribed in this molding impression and having at least one point of contact with the specific sacrificial insert), can in particular allow the use of metallic alloys having high liquidus temperatures and is also useful for limiting the reaction of the alloy with the insert. This is because the duration of the steps implemented at high temperature such as the injection step is extremely short, thus limiting or even eliminating phenomena of diffusion of elements between the metallic alloy and the sacrificial insert.

Once the metallic alloy is molded and solidified, the sacrificial insert, generally secured to the alloy, is eliminated and/or dissolved. For example, when sacrificial inserts composed of silicon are used, more particularly SOI (silicon on insulator) inserts, a KOH bath with a concentration of between 10 and 40% and a temperature of between 60 and 90° C. allowing a high rate of dissolution of the silicon and of any layer of $SiO_2$ is generally used.

According to an advantageous embodiment, the method does not comprise an additional step of removing material following the molding. Here "material" means the amorphous metallic alloy. The AMA part obtained by injection, solidification and separation of the insert may therefore be used as it is and corresponds to the final part.

According to another embodiment, the AMA part can then undergo one (or more) post-treatment operations making it possible to obtain the final geometry. These operations are generally of the "removal of material" type. These removals of material can be implemented by machining (mechanical, chemical, ultrasound, electroerosion, water jet, laser). The removal of material step may be implemented before or after separating the sacrificial insert and the molded part.

At the present time, the manufacture with extreme precision, for example a precision of less than or equal to 5 μm, of AMA parts of very small dimensions (in particular with a length of between 0.5 and 10 mm in the largest dimension of the part) and having a high height/thickness ratio requires complex manufacturing methods involving in particular a casting step and a thermoforming step. In order to keep the amorphous structure of the part during thermoforming, the alloy must therefore have sufficiently great thermal stability to allow forming without crystallizing.

The specific method described above makes it possible, unlike the methods of the prior art, to obtain parts such that the amorphous metallic alloy has:

i) a ΔTx of less than 100° C., preferably less than 80° C. and more preferentially still less than 60° C., ΔTx being the difference between the crystallization temperature Tx and the glass transition temperature Tg;

and/or ii) a standardized thermal stability criterion ΔTx/(Tl−Tg) of less than 0.18, preferentially less than 0.15 and more preferentially still less than 0.12, or again less than 0.10;

the part has a) a thickness of less than 100 μm and a height/thickness ratio greater than 8, or b) a thickness of less than 50 μm and a height/thickness ratio greater than 4, or c) a thickness of less than 40 μm and a height/thickness ratio greater than 2.

Advantageously, the part obtained according to the specific method described above is such that the faces of these flanks formed by means of the sacrificial insert have a mean roughness Ra of less than 1 μm, preferentially less than 0.5 μm and more preferentially still less than 0.1 μm.

According to a preferred embodiment, the metallic alloy constituting the part has a Tl greater than 700° C.

In general terms, the definitive parts that can be manufactured using the molding devices 1 or 101 can have, after optional removal of the surface material, small dimensions, complex shapes and diverse shapes. Furthermore, the definitive parts can have precise dimensions, that is to say small ranges of manufacturing tolerance, for example of a few microns.

It is possible to manufacture gearwheels, blades wound in spirals, bars, optionally stepped, straight or having zigzag arms forming angles with each other or rounded, plates of all forms provided with arms of all forms, combs, or other forms.

The definitive parts may have, in the direction of the thickness of the sacrificial inserts 7 and 107, thicknesses ranging from at least a tenth of a millimeter to a few millimeters.

The molding devices described can be applied to the manufacture of parts having an elastic deformation capacity of at least one and two tenths of a percent (1.2%), advantageously of at least one and a half percent (1.5%).

EXAMPLES

Example 1

Four parts made from an alloy composed partly of elements of the Zr, Cu and Al type having a standardized thermal stability criterion of less than 0.17, a ΔTx of less than 85° and a critical diameter equal to 11 mm were manufactured according to an injection molding method such that:

the sacrificial insert is an insert of the silicon (SOI) type the cavities of which have the following geometries:

minimum thickness in a cross section of the part=35 μm maximum height in the same cross section of the part where the minimum thickness has been determined=250 μm.

The following parameters were used:

the parameters during the injection step were as follows:

filling time of less than 5 ms pressure of 20 MPa cross section of a molding impression configured so that the diameter of the inscribed geometric spheres, in contact with its opposite lateral walls and having at least one point of contact with the sacrificial insert, is no more than 0.4 mm temperature of the mold equal to Tg±20° C.

Four parts were manufactured with these parameters. Following manufacture the remaining silicon was dissolved in a 20% solution of KOH at a temperature of 80° C. The parts were next analyzed by XRD in order to inspect the structure thereof. The XRDs obtained are presented in FIG. 10.

Example 2

A part made from an alloy composed partly of elements of the Zr, Cu, Ni, Ti and Al type having a standardized thermal stability criterion of less than 0.15, a ΔTx of less than 55° C. and a critical diameter Dc of 14 mm was manufactured in accordance with the method of example 1 except for the parameters indicated below:

the sacrificial insert is an insert of the silicon (SOI) type the cavities of which have the following geometries;

minimum thickness in a cross section of the part=100 μm maximum height in the same cross section of the part where the minimum thickness has been determined=360 μm Following the manufacture, the silicon remaining on the part was dissolved in a 20% KOH solution at a temperature of 80° C. The XRD analysis implemented on the part resulting from the method confirmed the amorphous character of the part obtained.

The invention claimed is:

1. A device for injection molding a metallic alloy, intended for manufacturing a part comprising an amorphous metallic alloy, said device comprising:

an injection mold delimiting a cavity that has a receiving face and a frontal molding face opposite the receiving face, a sacrificial insert, placed in said cavity and having a rear face, at least one contact zone of which is adjacent to at least one contact zone of said receiving face of the cavity and a front face located opposite said molding face of the mold and provided with a recessed shape, a molding impression corresponding to space left free in the cavity comprising the sacrificial insert, and an injection piston movable in a chamber of the mold, which communicates with the molding impression;

wherein the molding impression is configured so that a diameter of geometry spheres inscribed in said molding impression and having at least one point of contact with the sacrificial insert is no more than one and a half times (1.5 times) a critical diameter of the metallic alloy, optionally no more than one and two tenths times (1.2 times) the critical diameter of the metallic alloy, or no more than one time (1 time) the critical diameter of the metallic alloy, wherein said frontal molding face comprises a face of the cavity of the mold.

2. The device according to claim 1, wherein said cavity is configured so that, after removing the part provided with the sacrificial insert from the mold, at least said contact zone of the rear face of the sacrificial insert is uncovered.

3. The device according to claim 1, wherein the cavity has a peripheral face joined to the receiving face.

4. The device according to claim 1, wherein a peripheral edge of the receiving face is joined to an end edge, which is adjacent thereto, of the peripheral face of the cavity.

5. The device according to claim 1, wherein the sacrificial insert is in the form of a plate.

6. The device according to claim 1, wherein the frontal molding face comprises a frontal face of the injection piston.

7. The device according to claim 1, wherein the contact zone of the rear face of the sacrificial insert is adhesively bonded on top of the contact zone of the receiving face of the mold cavity.

8. The device according to claim 1, wherein at least one portion of a periphery of the sacrificial insert is inserted between two portions of the mold.

9. The device according to claim 1, wherein the receiving face of the cavity has a recess wherein the sacrificial insert is at least partly engaged.

10. The device according claim 1, wherein the sacrificial insert comprises a plurality of superimposed layers defining between said layers, at least one extension space of an impression.

11. The device according to claim 1, wherein the sacrificial insert comprises at least one material having a thermal conductivity of at least 20 W $m^{-1}$ $K^{-1}$, optionally at least 40 W $m^{-1}$ $K^{-1}$.

12. The device according to claim 1, for manufacturing one or mroe part having an elastic deformation capacity of at least 1.2%, optionally at least 1.5%.

13. A method for manufacturing at least one a molded part comprising an amorphous metallic alloy, using an injection mold according to claim 1, comprising:

placing the sacrificial insert on top of said receiving face of at least one portion of the mold, assembling portions of the mold, injecting into said molding impression a metal or a metallic alloy in a liquid state and solidifying the molded metal or metallic alloy to obtain the molded part having at least partially an amorphous structure, optionally having an amorphous structure, disassembling the mold portions and extracting the molded part provided with the sacrificial insert, and separating the sacrificial insert and the molded part.

14. A method for manufacturing a molded part made of an amorphous metallic alloy, using an injection mold according to claim 1, comprising:

assembling portions of the mold, placing the sacrificial insert on top of said receiving face of at least one portion of the mold, injecting into said molding impression a metal or a metallic alloy in the liquid state and solidifying the molded metal or metallic alloy to obtain the molded part having at least partially an amorphous structure, optionally having an amorphous structure, disassembling the mold portions and extracting the molded part provided with the sacrificial insert, and separating the sacrificial insert and the molded part.

15. The method according to claim 13, wherein the mold comprising the sacrificial insert is heated prior to the injection to a temperature of between 250° C. and Tg+100° C., optionally between Tg−150° C. and Tg+30° C. and optionally to Tg ±20° C., with Tg the glass transition temperature of the metallic alloy.

16. The method according to claim 13, wherein the sacrificial insert and the molded part are separated by destroying the sacrificial insert, optionally by destroying the sacrificial insert by a selective chemical attack in a bath.

17. The method according to claim 13, comprising, before or after the separation, removing surplus material so as to obtain a definitive part.

18. The method according to claim 13, comprising a subsequent heat treatment of the molded part and/or of a definitive part obtained.

19. The method according to claim 13, wherein injecting the metallic alloy has a duration of less than 100 ms, optionally less than 50 ms and optionally less than 20 ms.

* * * * *